US006077577A

United States Patent [19]

Spatorico et al.

[11] Patent Number: 6,077,577

[45] Date of Patent: Jun. 20, 2000

[54] COMPACT PRESSURE-SENSITIVE TAPE CORE

[75] Inventors: Anthony L. Spatorico; Francis R. Brockington, both of Columbia; Jesse J. Fuller, Jr., Lexington, all of S.C.

[73] Assignee: Anchor Continental, Inc., Columbia, S.C.

[21] Appl. No.: 09/002,641

[22] Filed: Jan. 5, 1998

[51] Int. Cl.[7] ..... B29D 22/00

[52] U.S. Cl. ..... 428/34.1; 242/609.1; 242/613.3; 428/40.1

[58] Field of Search ..... 428/40.1, 34.1; 206/389, 411; 242/588, 599, 537, 609.1, 609.2, 613.3

[56] References Cited

U.S. PATENT DOCUMENTS

| | | | |
|---|---|---|---|
| 3,006,464 | 10/1961 | Snell | 206/59 |
| 3,743,086 | 7/1973 | Aldrich | 206/52 |
| 3,763,999 | 10/1973 | Yovanovich | 206/50 |
| 3,767,039 | 10/1973 | Schroter | 206/59 |
| 3,899,075 | 8/1975 | Hall et al. | 206/411 |
| 3,940,085 | 2/1976 | Campbell | 242/115 |
| 4,176,804 | 12/1979 | Nemoto et al. | 242/68.5 |
| 4,471,919 | 9/1984 | Leunig | 242/115 |
| 4,880,181 | 11/1989 | Drahanowsky | 242/74 |
| 5,269,421 | 12/1993 | Taylor | 206/411 |

*Primary Examiner*—Ellis Robinson
*Assistant Examiner*—Laura L. Lee
*Attorney, Agent, or Firm*—Nelson Mullins Riley & Scarborough

[57] ABSTRACT

The present invention is directed to a compact tape core upon which a pressure-sensitive tape may be wound. The tape core comprises two rectangular-shaped identical halves which may or may not be joined together permanently at one end with a hinge mechanism. Each tape core half has apertures and mounting studs for clamping the two halves together around a winding mandrel so that pressure-sensitive tape may be wound onto the outer surface of the tape core. In certain embodiments of the present tape core, one or both of the outer surfaces of the tape core have an inward or concave shape relative to the horizontal plane and in other embodiments one or both of the outer surfaces exhibit a bulging or convex shape relative to the horizontal plane. Another embodiment of the compact tape core has a keyway with supporting arms disposed in the cavity between the core halves for mounting the core onto a winding mandrel.

19 Claims, 5 Drawing Sheets

COMPACT PRESSURE-SENSITIVE TAPE CORE

FIELD OF THE INVENTION

The present invention relates to cores upon which pressure-sensitive tapes can be wound and unwound. Specifically, the present invention relates to a compact, typically pocket-sized, tape core that allows tape to be wound onto and unwound from it efficiently.

BACKGROUND OF THE INVENTION

Most cores upon which pressure-sensitive tapes are wound are cylindrical in shape and are formed in a single, unitary, piece. The cylindrical tape core defines a cavity that is often useful for grasping the tape by the hand when unwinding for use. In addition, tape typically can be unwound from such cylindrical cores in an efficient manner and without creating creases in the tape. As is known in the art, creases in pressure-sensitive adhesive tapes will result in areas where the adhesive will typically be picked off in time and the tape will become non-adhering along the crease.

Typically, these cylindrical cores will be placed on a winding mandrel and pressure-sensitive tapes, such as masking or duct tape, will be wound onto the outer surface of the cylinder as the winding mandrel rotates. A number of these cores will usually be placed on the mandrel so that more than one roll of tape may be obtained at a time.

Generally, a wide sheet of pressure-sensitive tape will first be formed and then provided to a slitting machine for cutting the tape into narrower widths that are commercially acceptable for individual rolls. After the tape is slit, the tape is then provided to the tape cores mounted on the winding mandrel and the tape is wound thereon as the mandrel rotates.

Typical tapes that are wound on cylindrical cores are usually bulky and not compact. Most tapes wound onto typical cores are not sufficiently compact to place in the pocket of one's clothing or to fit into a confined space. Obviously, smaller rolls of tape may be formed that are compact, but many of these are still wound onto a cylindrically-shaped core. For example, most adhesive electrical tape is sufficiently compact to place in one's pocket. However, electrical tape is normally provided on a cylindrical core.

In response to the need for a compact roll of tape, the prior art has developed a pressure-sensitive tape core that is sufficiently small and compact so that it will fit into spaces that other commercial available tape rolls will not. In particular, the core for this prior art tape roll is shown in FIGS. 1 and 2. The prior art tape core 1 is in the form of an elongated rectilinear block having rounded ends 8. The shape of this prior art core 1 is defined by a half 2 having an upper flat, or planar, surface and half 3 having a lower flat, or planar, situated between two rounded ends 8. These two separate plastic halves 2 and 3 are connected at rounded ends 8 and define a generally symmetrical cavity 9 therebetween. This prior art core 1 is generally symmetrical in that, viewed from the side, the core has a top half that is horizontal, or planar, and a bottom half that is horizontal, or planar.

As shown in FIG. 2, the two halves 2 and 3 which form the prior art tape core 1 are not connected until they are snapped together on the winding mandrel. The two halves 2 and 3 are held together through a stud/aperture connecter system. Each half has two studs 4 and 5 projecting from one enlarged end of the half and two mating holes, or apertures, 6 and 7 defined by the other enlarged end of the half. Thus, when placed together, the studs 4 and 5 projecting from one enlarged end of a half will mate with the apertures 6 and 7 on the other enlarged end of the other half portion so that the halves 2 and 3 can be positioned together to form prior art tape core 1. The ends of the core are then taped to securely fasten the halves together prior to winding tape onto the core. Because the two halves 2 and 3 are identical and have both of the studs 4 and 5 on one end of the half and both of the apertures 6 and 7 on the other end of the half, the halves 2 and 3 must be aligned properly when mounting on the mandrel. In other words, one cannot properly mount the core onto the mandrel if the halves are positioned so that the studs 4 and 5 on one half are aligned with the studs 4 and 5 on the other half. The result of such a misalignment would be that the studs would abut one another and the apertures would abut one another. Thus, in order to mount this prior art core onto the mandrel, the core halves 2 and 3 must be properly aligned prior to mounting.

In addition, in this prior art core, there is no mechanism by which the core is held tightly on the mandrel. The mandrel used to wind tape onto these cores is in a rectangular blocked shape, with outer planar winding surfaces. The cavity formed between the two halves of this prior art core is symmetrical in that the distance between the top inner surface and the bottom inner surface that defines the cavity is constant throughout the length of the core between rounded ends 8. The rectangular-shaped, flat cores of the prior art devices have a tendency to slide off of and not be tightly held on the blocked-shaped mandrel.

In addition, this completely symmetrical design of the prior art device often hampers unwinding of tape by the consumer. Due to the fact that the outer winding surfaces of the core are planar, the tape generally unwinds in lengthwise sections, with the length defined by the distance between rounded ends. Thus, when unwinding tape from around the circumference of the core, the unwind is slightly hampered.

Thus, there exists a need for a compact tape core that can be securely mounted on a mandrel for winding tape onto the core. In addition, there is a need for a compact tape core that prealigns itself to increase manufacturing efficiencies when mounting the core onto the mandrel. In addition, there exists a need to improve upon the unwind characteristics of a tape wound onto a compact tape core.

SUMMARY OF THE INVENTION

It is an object of the present invention to provide a compact tape core upon which pressure-sensitive adhesive tape may be wound and unwound.

It is an object of the present invention to provide a compact tape core that may be readily and easily mounted to a mandrel for winding pressure-sensitive tape onto the core.

It is another object of the present invention to provide a compact tape core that may be snugly fit onto a winding mandrel prior to having tape wound onto the core.

It is a further object of the present invention to provide a compact tape core that improves the unwind characteristics of tape being unwound from the core.

Generally, the present invention is directed to a compact tape core upon which a pressure-sensitive tape may be wound. Specifically, the tape core comprises two rectangular-shaped identical halves which may or may not be joined together permanently at one end with a hinge mechanism. Each tape core half has a connection means located at two rounded half end portions which border an elongated center portion. The connection means include apertures and mounting studs for clamping the two halves together around a winding mandrel so that pressure-sensitive tape may be wound onto the outer surface of the tape core. Furthermore, the tape core halves, when not joined permanently together, are symmetrical in that they can be joined together relative to their studs and apertures without having to be prearranged in a specific orientation.

Furthermore, in certain embodiments of the present tape core, the tape core will have at least one relatively unflat, or nonplanar, outer surface. The present invention includes an embodiment wherein one or both of the outer surfaces of the tape core have an inward or concave shape relative to the horizontal plane and an embodiment wherein one or both of the outer surfaces exhibit a bulging or convex shape relative to the horizontal plane. The inventive features of the present tape core result in substantial improvements over the prior art compact, pocket-sized, tape core presently available.

Another embodiment of the compact tape core defines a unitary or separable compact core having a keyway with supporting arms disposed in the cavity between the core halves. The keyway may be utilized for mounting onto a winding mandrel, as well as for grasping the core with one's fingers during unwinding of the tape.

Additional embodiments of the present invention include the use of a winding mandrel having an enlarged center width section for maintaining a compact tape core mounted securely thereon.

BRIEF DESCRIPTION OF THE DRAWINGS

A full and enabling disclosure of the present invention, including the best mode thereof, to one of ordinary skill in the art is set forth more particularly in the remainder of the specification, including reference to the accompanying figures, in which.

DETAILED DESCRIPTION OF PREFERRED EMBODIMENT

It is to be understood by one of ordinary skill in the art that the present discussion is a description of exemplary embodiments only and is not intended as limiting the broader aspects of the present invention, which broader aspects are embodied in the exemplary construction.

Figure 3:
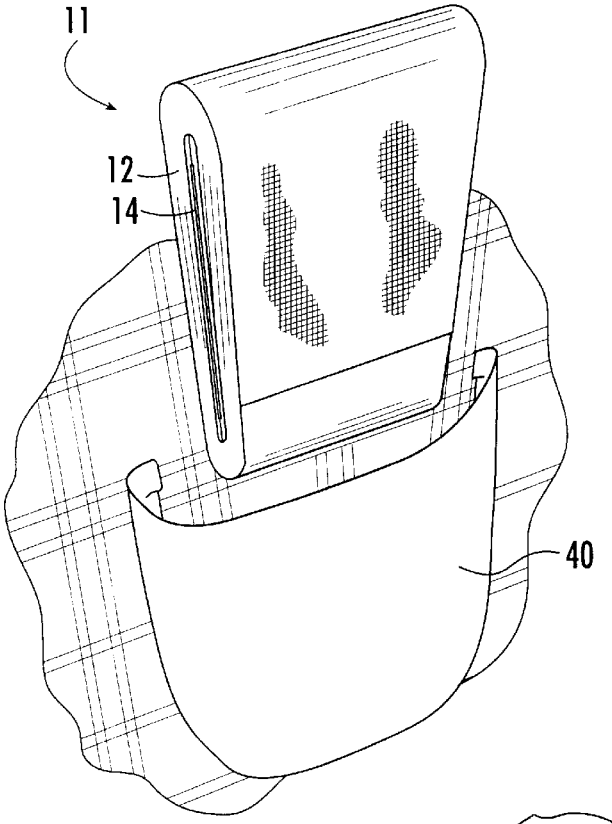
FIG. 3 is a plan view of a roll of pressure-sensitive tape shown wound onto the compact tape core of the present invention and illustrating its insertion into a shirt pocket.

As shown in FIG. 3, the present compact tape core with tape wound thereon 11 is sufficiently compact so that it may be inserted into typically-sized clothing pockets or into other confined spaces. Pressure-sensitive tape 12 is wound onto the compact tape core 14 and, in most cases, may be easily inserted into a shirt pocket 40. The use of the present inventive tape core for carrying a pressure-sensitive tape addresses many of the unsolved problems of the prior art as discussed herein.

Figure 4:
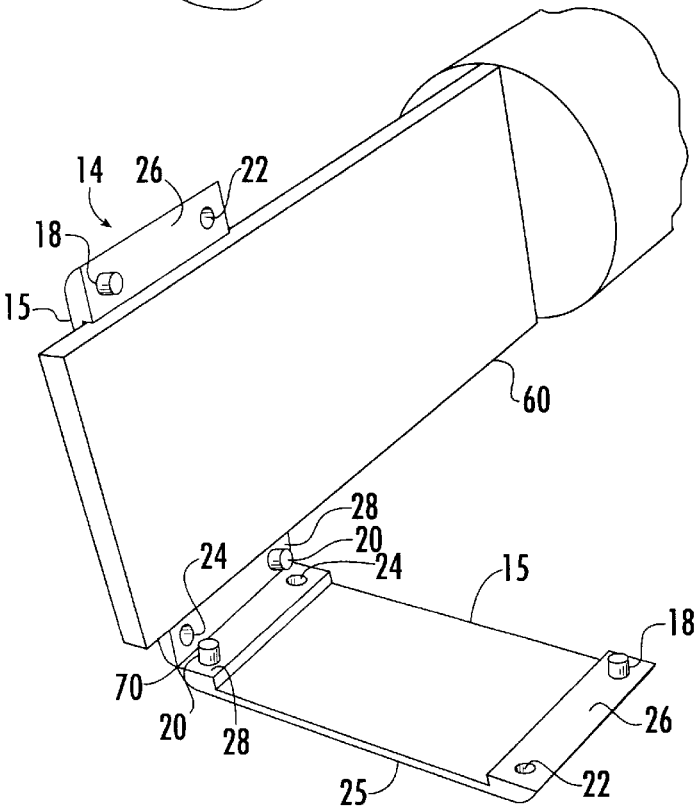
FIG. 4 is a plan view of one embodiment of the present inventive tape core illustrating, in separated fashion, the mounting of the tape core onto a winding mandrel.

In one particular embodiment of the present invention, the compact tape core is comprised of two identical halves 15 as shown in FIG. 4. In this particular embodiment, identical halves 15 are joined together at a hinge portion 70. By using a hinge mechanism, preferably integrally formed with identical halves 15, the halves 15, thus, will always be aligned for proper connections as explained herein.

In the particular embodiment having a hinge portion 70 as shown in FIG. 4, identical halves 15 will be substantially rectangular in shape. Each half is comprised of an elongated rectangular portion 25 and a first rounded half end portion 26 and a second rounded half end portion 28. The first and second rounded half end portions 26 and 28 are located at opposite ends of elongated rectangular portion 25. As can be more readily seen in FIG. 6, the rounded half end portions 26 and 28 will have a greater depth than the elongated rectangular portions 25 so that when the two identical halves 15 are connected together, a cavity will be defined by the rounded ends 16 and elongated rectangular portions 25.

A projecting member, or first stud, 18 is mounted on first rounded half end portion 26 and, in like fashion, a projecting member, or second stud, 20 is mounted on second rounded half end portion 28. In addition, first rounded half end portion 26 will define a first aperture, or hole, 22 therethrough and second rounded half end portion 28 will, in like manner, define a second aperture, or hole, 24 therethrough. As shown in FIG. 4, first stud 18 will be in diagonal alignment across the elongated rectangular portion 25 from second stud 20. Likewise, first aperture 22 will be located diagonally across elongated rectangular portion 25 from second aperture 24. Thus, the resulting half will define diagonally opposite apertures 22 and 24 and diagonally opposite studs 18 and 20.

Figure 8:
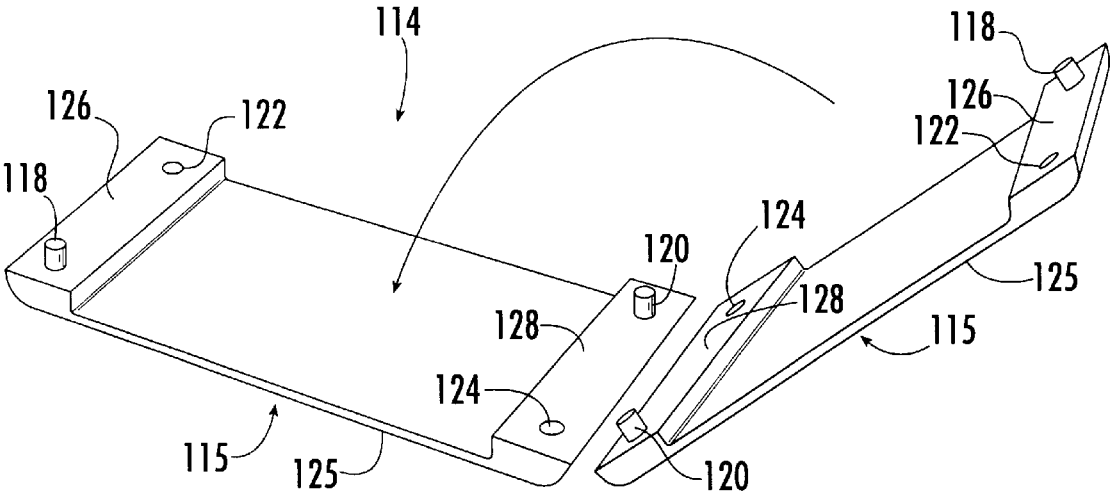
FIG. 8 is a plan view of an embodiment of the present compact tape core that has been taken apart to illustrate the separate halves of the core.

As can be seen in FIG. 4, and as can be seen more readily with respect to the embodiment shown in FIG. 8, studs 18 and 20 will be aligned on halves 15 to mate with apertures 22 and 24 when the identical halves 15 are placed in mating contact with each other. Although the connection means specifically shown in the drawings of the present invention are a stud/aperture arrangement, it will be appreciated that other connection means could also be utilized. For example, it will be appreciated that other connection means such as a single stud/aperture arrangement of the type utilized herein, wherein instead of two studs and two apertures with a hinge mechanism, only one stud and one aperture with a hinge mechanism is utilized. In addition, it will be appreciated that the cylindrically shaped studs could take on various other shapes and configurations, provided that they will mate with a aperture of like configuration in a male/female connecting relationship.

As previously explained, FIG. 4 illustrates an embodiment that utilizes a hinge mechanism, which is sometimes known in the industry as a living hinge, to maintain identical halves 15 in permanent securement with each other at one end thereof. Typically, a hinge portion 70 can be created by molding the identical halves 15 integrally in a plastic molding operation. Other methods, however, may also be utilized in joining one end of a half 15 with one end of another half 15.

The hinge portion 70 will join identical halves 15 together and will allow them to pivot about hinge portion 70. Once the compact tape core 14 is placed around a rectangular block-shaped winding mandrel 60, as shown in FIG. 4, identical halves 15 may be pivoted about hinge portion 70 so as to mate first studs 18 with first apertures 22 and second studs 20 with second apertures 24. When identical halves 15 are thus connected, a compact tape core is formed. Once mounted on the mandrel, tape may be wound thereon as illustrated in FIG. 5.

Figure 5:
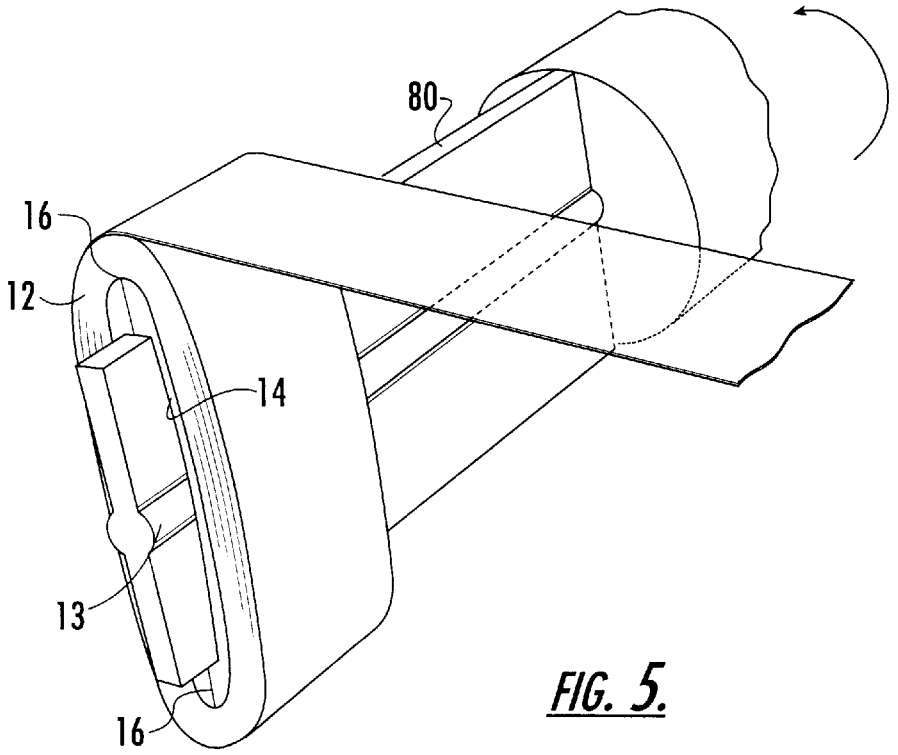
FIG. 5 shows the winding of a pressure-sensitive tape onto the compact tape core of the present invention which has been mounted onto an embodiment of a winding mandrel which is also included within the present invention.

FIG. 5 illustrates an alternative mandrel 80 which has an enlarged width center portion for increasing the snugness of the fit between tape core 14 and the winding mandrel. In FIG. 5, the compact tape core 14 is illustrated mounted on mandrel 80 and having a pressure-sensitive tape 12 being wound thereon. Winding mandrel 80 has a constant height across its width except for increased width portion 13. Increased width portion 13 may bulge on either side, or both sides, of winding mandrel 80 to define the increased width to create a friction fit between the inner surfaces of compact tape core 14 and winding mandrel 80.

It will also be appreciated that any of the various embodiments of the present invention may be utilized with winding mandrel 80 or with a symmetrical winding mandrel 60 which is blocked in shape. In addition, it will further be appreciated that winding mandrel 80 may take on a number of various forms. In particular, enlarged portion 13 may be situated anywhere along the mandrel, provided that the cavity defined by tape core 14 can fit around the enlarged portion of the winding mandrel and form a friction-fitted engagement therewith. In addition, it will further be appreciated that the winding mandrel could have an enlarged portion on only one surface.

It can be appreciated that mandrel 80 in this embodiment would be rotating in a counterclockwise fashion as driven by conventional tape winding equipment. As will also be appreciated, tape 12 will be supplied from conventional tape forming and slitting equipment. It will also be appreciated, although not shown, that more than one compact tape core 14 may be mounted on any of the various winding mandrels disclosed herein so as to improve the efficiencies of the winding process.

Figure 6:
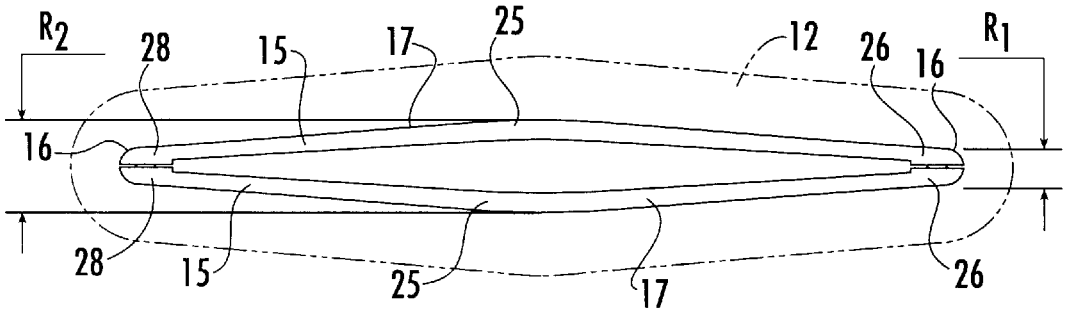
FIG. 6 is a side view of an embodiment of the present compact tape core with tape wound thereon shown in phantom.
Figure 7:
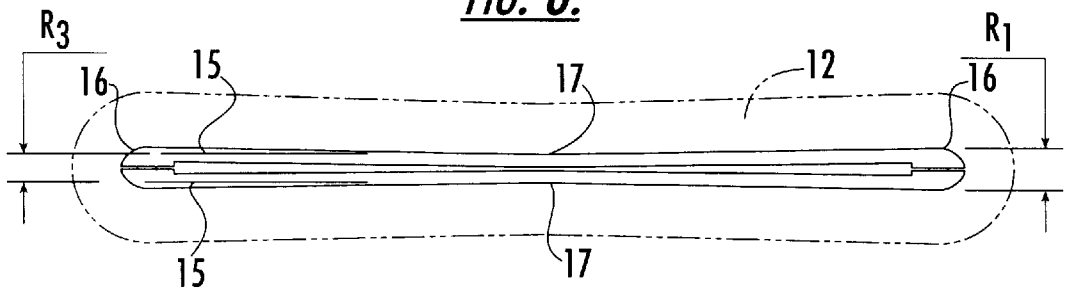
FIG. 7 is a side view of an embodiment of the present compact core with tape wound thereon shown in phantom.

FIGS. 5, 6 and 7 also illustrate opposed rounded ends 16 that are formed when identical halves 15 are brought together to connect the rounded half end portions 26 and 28. Such rounded, or parabolic-shaped, ends 16 are employed in order to reduce the amount of creasing that would result in a tape wound onto a pointed-cornered, block-shaped core. In addition, the use of rounded corners on rounded ends 16 allows for more proficient and smooth winding and unwinding.

Two alternative embodiments of the present compact tape core are illustrated in FIGS. 6 and 7. FIG. 6 illustrates an embodiment of the compact tape core wherein the core exhibits a convex, or bulging, shape. This shape is also referred to herein as "elliptical." In these embodiments, the outer winding surfaces 17 of identical halves 15 are no longer planar until a point near the rounded ends 16. Instead, the outer surfaces 17 of the embodiment shown in FIG. 6 illustrate a bulging portion at some point along elongated rectangular portions 25. The embodiment shown in FIG. 6 is characterized in that at least one identical half 15 has a curvature that is convex to the horizontal plane when viewed from the side. This shape may also be described as outward parabolic relative to the center line horizontal plane bisecting the lengthwise run of the compact tape core.

The embodiment shown in FIG. 6 has certain distinct advantages over the use of a tape core that utilizes completely planar identical halves. For example, the tape core illustrated in FIG. 6 creates a finger hole, or grasping portion, within the cavity defined between identical halves 15 so that someone unwinding the tape from the core may insert their finger or some other device to unwind the tape more readily. In addition, the embodiment illustrated in FIG. 6 allows for a more uniform unwind of tape from the core. This uniformity of unwind is achieved because the tape core illustrated in FIG. 6 is more rounded or cylindrical in shape than a core that utilizes two completely planar outer surfaces. This allows the tape to be unwound from the core more efficiently.

Figure 9:
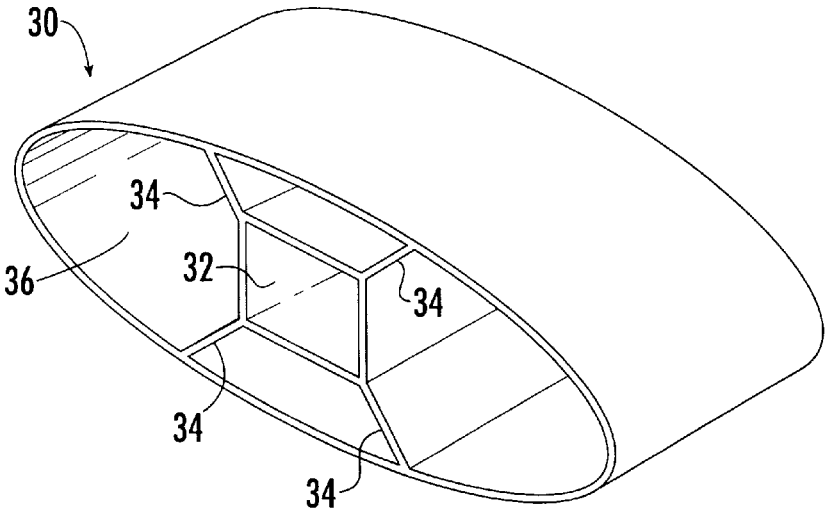
FIG. 9 is an embodiment of a compact tape core which is part of the present invention.

In addition, the use of an embodiment such as shown in FIG. 6 would allow the mounting of a finger hole, or keyway, such as shown in FIG. 9 between the identical halves 15. Although FIG. 9 shows a one piece molded compact tape core, the keyway 32 with supporting arms 34 could easily be integrated into the compact tape core shown in FIG. 6. In such an arrangement, the supporting arms 34 and keyway 32, which could be of any shape as explained below, could be unitarily formed with either half of the tape core, or could have a portion formed with one identical half 15 and a portion formed with the other identical half 15 so that when the identical halves 15 are brought together in connecting arrangement, the keyway structure is formed. As explained below, this keyway can be utilized for the insertion of a special mandrel therethrough during winding, for the insertion of a key to facilitate unwinding, or for the insertion of or grabbing by one's fingers during unwinding of the pressure-sensitive tape.

The convex-configured, or "positive elliptical," embodiment shown in FIG. 6 can be relatively defined in terms of the distances between the outer surfaces 17 of identical halves 15. As illustrated on FIG. 6, the distance between the farthestmost separated points on outer surfaces 17 when identical halves 15 are connected is designated as "$R_2$." The distance between the upper surface of a rounded end 16 and the lower surface of rounded end 16 is illustrated in FIG. 6 by the designation "$R_1$." Distance $R_1$ is the distance between the outer surfaces 17 at a point on rounded ends 16 when the outer surface has become relatively flat to the horizontal plane. In the convex, or positive elliptical, configuration illustrated in FIG. 6, $R_2$ will be greater than $R_1$. Thus, the relationship between $R_2$ and $R_1$ for the positive elliptical embodiment illustrated in FIG. 6 can be represented by $R_2>R_1$.

It will appreciated that in the positive elliptical configuration, at least one of the identical halves 15 will be nonplanar. A configuration could be utilized wherein one identical half 15 is planar and the other identical half 15 exhibits the convex shape shown. In this particular arrangement, the halves will not necessarily be "identical" as that term is typically utilized. In this described embodiment, the compact tape core will exhibit a "partial elliptical shape," with only one of the identical halves 15 being curved convexly when viewed from the side.

A concave, or negative elliptical, configuration of the compact tape core of the present invention is illustrated in FIG. 7. In this negative elliptical arrangement, $R_1$ (the distance between the upper and lower surfaces of rounded end 16 at a point when the outer surface has become relatively flat) will be greater than $R_3$ (the minimum distance between outer surfaces 17). The relationship between $R_1$ and $R_3$ can be expressed as $R_1>R_3$. Thus, in the invention, $R_2>R_1>R_3$.

Several advantages may be obtained in this negative elliptical embodiment which are not realized when utilizing a symmetrical tape core. For example, in this negative elliptical arrangement, the compact tape core may be frictionally set on the winding mandrel. The concave surface(s) allow for a snug fit of the tape core on the winding mandrel to lessen any slippage that might be caused during the winding process. In this manner, a block-shaped mandrel could be utilized without resorting to the enlarged-portion mandrel 80 illustrated in FIG. 5. In addition, the placement of the core on the mandrel will actually decompress the elliptical shape somewhat so that a relatively symmetrical core will be mounted on the mandrel during winding.

Obviously, the negative elliptical arrangement illustrated in FIG. 7 will also result in less volume being taken up by the actual roll of tape after the winding process is complete. There will be a slightly concave portion along the lengthwise run of the tape roll. In addition, as in the embodiment shown in FIG. 6, the rounded corners 16 remain at a fixed radius which results in unwinding advantages, including the avoiding of creases.

It will be appreciated that in the negative elliptical configuration, at least one of the identical halves 15 will be nonplanar. A configuration could be utilized wherein one identical half 15 is planar and the other identical half 15 exhibits the concave shape shown. In this particular arrangement, the halves are not "identical." In this described embodiment, the compact tape core will exhibit a "partial elliptical shape," with only one of the identical halves 15 being curved concavely when viewed from the side.

Figure 1:
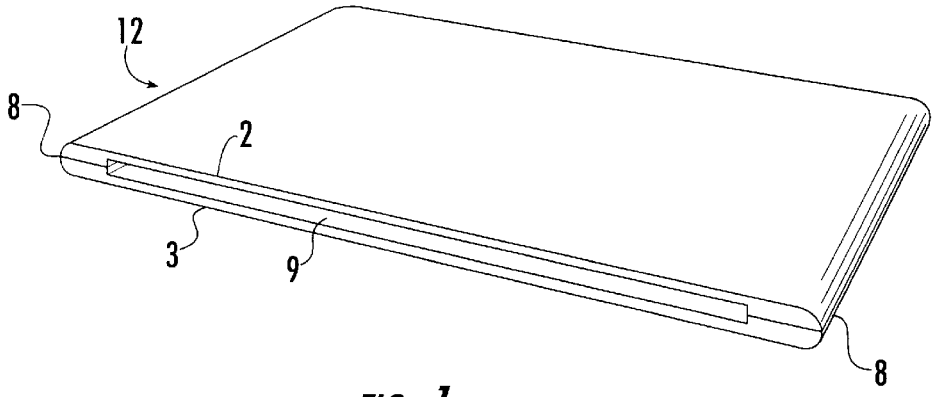
FIG. 1. (PRIOR ART)
FIG. 1 is a plan view of a prior art compact tape core.
Figure 2:
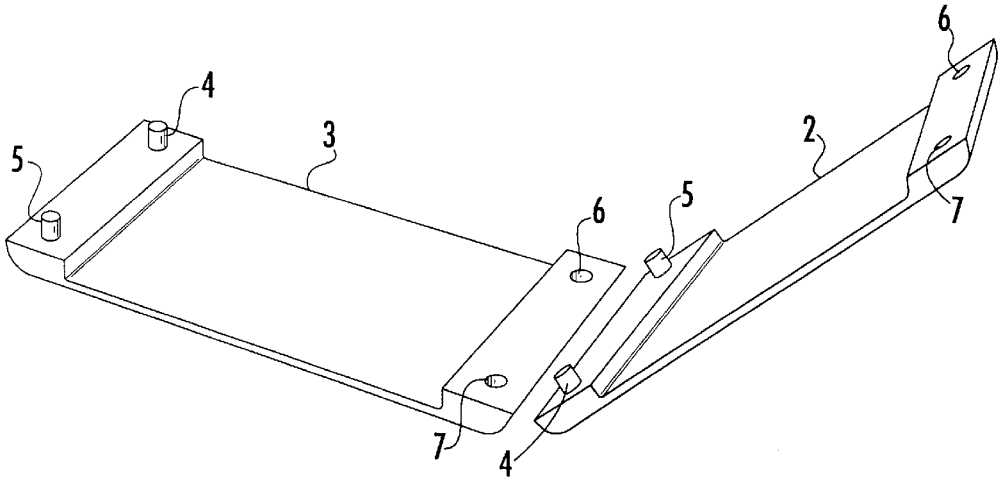
FIG. 2. (PRIOR ART)
FIG. 2 is a plan view of the prior compact tape core shown in FIG. 1 that has been taken apart to show its separated halves.

FIGS. 8–11 illustrate other embodiments of the present invention. In these and later figures, comparable features as previously described on other embodiments of the present inventive compact tape core are utilized. Such comparable features in FIGS. 8–11 are indicated by numerals that differ by a factor of 100 from the numbering scheme employed in FIGS. 3–7. As shown at FIG. 8, identical halves 115 of compact tape core 114 are not joined together at a hinge portion as in FIG. 4 but, instead, are two separate structures. The halves 115, however, are otherwise identical to the halves previously described in that first studs 118, second studs 120, first apertures 122, and second apertures 124 are placed in the same positions for every individual half 115. The studs and apertures are placed in this arrangement with the studs 118 and 120 being diagonally opposed to one another and the apertures 122 and 124 being diagonally opposed to one another. This results in a tape core that is easy to assemble when placing on the winding mandrel. A worker picking up one identical half 115 and another identical half 115 will not be required to ensure a correct alignment between studs and apertures as required in the prior art device illustrated in FIGS. 1 and 2. As illustrated at FIGS. 1 and 2, halves 2 and 3 must be properly aligned, stud to aperture, so that the two halves can be connected in a mating relationship to form the tape core.

Figure 11:
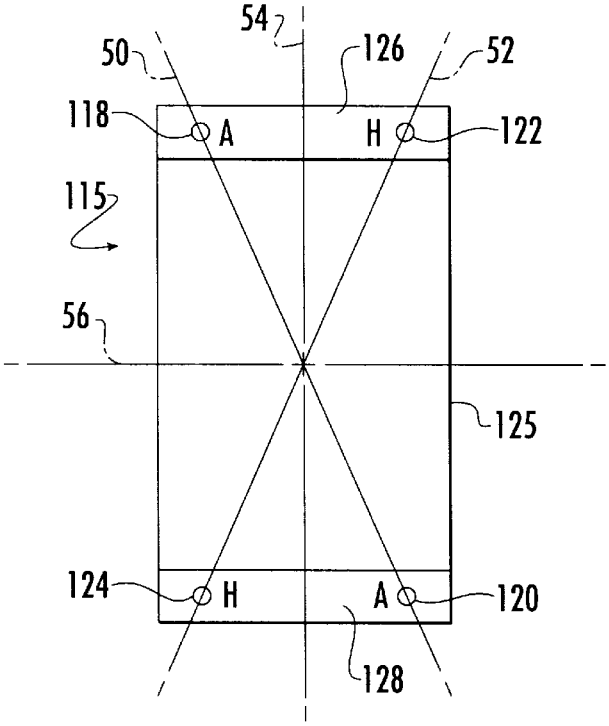
FIG. 11 is a bottom view of one-half of the present inventive compact tape core illustrating various axes.

The present inventive tape core shown in FIG. 8 requires no special alignment. This is due to the fact that each identical half 15 of the compact tape core 14 of the present invention has several axes of symmetry. Those axes also result in planes of symmetry. As shown in FIG. 11, lines 50 and 52 illustrate a first and second axis of symmetry running diagonally from stud to stud and from aperture to aperture. If the half 115 were cut along either first axis of symmetry 50 or second axis of symmetry 52, identical and symmetrical portions would be obtained. Likewise, third axis of symmetry 54 and fourth axis of symmetry 56 indicate mirror image axes. If half 115 were cut along either third axis of symmetry 54 or fourth axis of symmetry 56, two mirror image portions would be obtained.

It will also be appreciated that various embodiments of the positive and negative elliptical configuration of the present invention may be created from a half that has one nonplanar elongated portion and one planar elongated surface. For example, the underside of a half which borders the cavity formed by the connected halves may be flat, with the upper, outer surface 17 being curved. This can be created by having more material in the center of elongated center portion 25 in the convex configuration or less material in the center of the elongated center portion 25 in the concave configuration.

In one configuration, typical measurements for the various components of the compact tape core shown in FIG. 8 are as follows:

Diameter of studs 118 and 120=0.098"

Height of studs 118 and 120=0.069"

Width of one identical half 115=1.889"

Diameter of apertures 122 and 124=0.097"

Distance between center of studs 118 and aperture 124 and from center of aperture 122 to center of stud 120=2.976"

Length of one identical half 115=3.190"

Thickness of elongation portion 125=0.050"

Width of half rounded ends 126 and 128 0.215"

Height of half rounded ends 126 and 128=0.069"

As already indicated, FIG. 9 illustrates an embodiment of the present compact tape core 30 that is in the form of the positive ellipse described above. A passageway, or keyway, 32 is disposed within cavity 36 of compact tape core 30. This keyway is suspended generally in the center of the cavity 36 by one or more supporting arms 34. The embodiment shown in FIG. 9 illustrates a relatively square passageway supported at its corners by four supporting arms 34. It will be appreciated that, for the purposes described herein, keyways in the shape of octagons, hexagons, polygons, triangles, cylinders, and the like, may be utilized. In addition, various numbers of supporting arms 34 may be utilized, depending on the particular shape, as well as depending on the structural integrity desired.

Keyway 32 may be utilized for mounting compact tape core 30 on a winding mandrel having a particular shape. Obviously, the particular compact tape core 30 of FIG. 9 with a square keyway may be mounted on a square block-shaped winding mandrel for winding pressure-sensitive tape onto the core. Although, the embodiment shown in FIG. 9 is a one-piece molded core, it will be appreciated by those of ordinary skill in the art that the core itself could be designed in two halves which may be joined as previously described.

Another advantage of forming a keyway 32 in the positive elliptical arrangement shown in FIG. 9 is that it allows one's fingers to grasp a portion of the core during unwinding of the tape. In addition, the tape roll could be placed on an unwinding structure that rotates as tape is unwound from the core. This allows unwinding without actually having to grasp the roll.

Figure 10A:
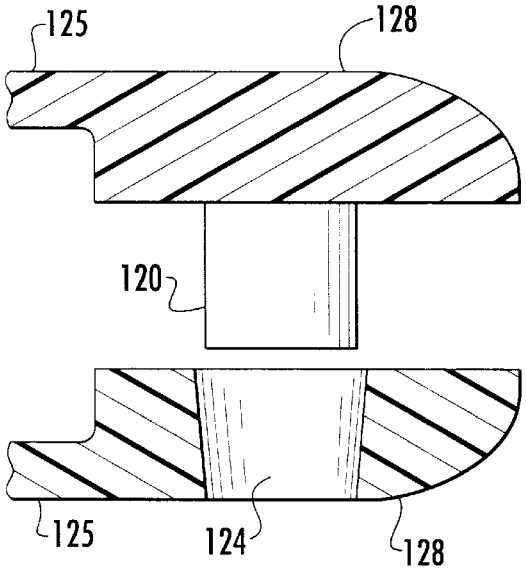
FIG. 10*a* is a portion of a cross section of a rounded end portion of the present compact tape core illustrating the relative positions of a stud and an aperture prior to joining the two halves of the compact tape core together.
Figure 10B:
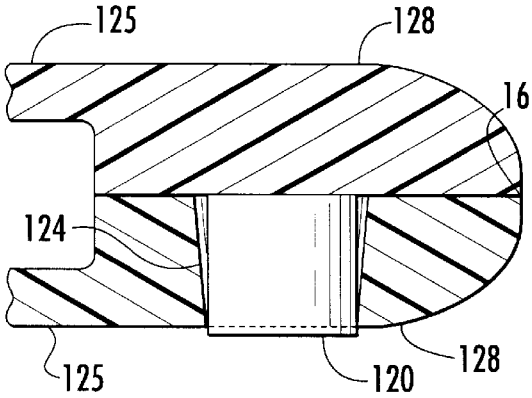
FIG. 10*b* shows the portion of the compact tape core illustrated in FIG. 10*a* after joining the two halves of the tape core together.

FIGS. 10*a* and 10*b* illustrate an embodiment of a connecting system that may be utilized to mate the studs 118 and 120 of the present identical halves 115 with the apertures 122 and 124 of the identical halves 115. In particular, FIG. 10*a* illustrates a cross section of the rounded half end portions 128 just prior to joining them together in a mating relationship. The cross section is taken along the center of a stud 120 and an aperture 124. As indicated, stud 120 may be a symmetrical cylinder, either filled or hollow. Aperture 124 defines a frustoconical shape which has a wider diameter at its upper opening and which then narrows in diameter toward a smaller opening. When the halves are joined together as illustrated in FIG. 10*b*, stud 120 is in a snug engaging relationship with aperture 124. In fact, the lower portion of stud 120 may bulge out slightly from the aperture 124 to make a snap-type connecting relationship between the two identical halves.

It will be appreciated that, in most instances, the present compact tape core will be molded out of a plastic material, although the present invention is not limited to any particular material for forming the tape core. If proper structural integrities could be maintained, paperboard and other materials could be utilized in forming the compact tape cores.

Although a preferred embodiment of the invention has been described using specific terms, devices, and methods, such description is for illustrative purposes only. The words used are words of description rather than of limitation. It is to be understood that changes and variations may be made by those of ordinary skill in the art without departing from the spirit and scope of the present invention which is set forth in the following claims. In addition, it should be understood that aspects of the various embodiments may be interchanged, both in whole or in part.

What is claimed is:

1. A compact tape product comprising a pressure-sensitive tape that is wound onto a non-cylindrical core, said core comprising:

two rectangular-shaped identical core halves, each of said core halves having an elongated center portion and two rounded half end portions;

each of said halves comprising connection means at said rounded half end portions to allow said halves to be joined together in a connecting relationship;

said halves being permanently joined together at one rounded half end portion therewith a hinge mechanism;

said halves being connected at the other of said rounded half end portion through the connecting of said connection means to form two rounded core ends;

wherein said connecting means comprises an arrangement of at least two studs and two apertures located on said halves so that said studs are located diagonally with respect to each other and said apertures are located diagonally with respect to each other; and a cavity defined by the connection of said halves, said cavity having at least a partial elliptical shape when viewed from the side.

2. A compact tape product as defined in claim 1, wherein at least one of said halves is non-planar and wherein said one half that is non-planar exhibits a concave curvature relative to the horizontal plane when viewed from the side.

3. A compact tape product as defined in claim 2, wherein both of said halves exhibit a concave curvature relative to the horizontal plane when viewed from the side.

4. A compact tape product as defined in claim 1, wherein at least one of said halves is non-planar and wherein said one half that is non-planar exhibits a convex curvature relative to the horizontal plane when viewed from the side.

5. A compact tape product as defined in claim 4, wherein both of said halves exhibit a convex curvature relative to the horizontal plane when viewed from the side.

6. A compact tape product comprising a pressure-sensitive tape wound onto a non-cylindrical compact tape core, said core comprising:

two separate rectangular-shaped identical core halves, each of said core halves having an elongated center portion and two rounded half end portions;

each of said halves comprising connecting means at said rounded half end portions to allow said halves to be joined together in a connecting relationship, said connecting means comprising an arrangement of at least two studs and two apertures located on said halves so that said studs are located diagonally with respect to each other and said apertures are located diagonally with respect to each other; and said halves being connected at their rounded half end portions through the connecting of said connecting means to form two rounded core ends.

7. A compact tape product as defined in claim 6, wherein said connected halves define at least a partial elliptical shape when viewed from the side and wherein at least one of said halves is non-planar.

8. A compact tape product as defined in claim 7, wherein both of said halves are non-planar.

9. A compact tape product as defined in claim 7, wherein said partial elliptical shape is a positive ellipse wherein at least one of said halves exhibits a convex curvature relative to the horizontal plane when viewed from the side.

10. A compact tape product as defined in claim 9, wherein both of said halves exhibit a convex curvature relative to the horizontal plane when viewed from the side.

11. A compact tape product as defined in claim 7, wherein said partial elliptical shape is a negative ellipse and wherein at least one of said halves exhibits a concave curvature relative to the horizontal plane when viewed from the side.

12. A compact tape product as defined in claim 11, wherein both of said halves exhibit a concave curvature relative to the horizontal plane when viewed from the side.

13. A compact tape product as defined in claim 9, further comprising a keyway situated between said halves when said halves are joined together.

14. A compact tape product as defined in claim 13, wherein said keyway is mounted between said halves by supporting members secured to each of said halves.

15. A compact tape product as defined in claim 6, wherein said halves are permanently joined together at one rounded half end portion with a hinge mechanism.

16. A compact tape product comprising a pressure-sensitive adhesive tape wound onto a non-cylindrical compact tape core, said core comprising:

upper and lower rectangular-shaped identical core halves, each of said halves having an elongated center portion and two rounded half end portions;

each of said halves comprising connecting means at their rounded half end portions to allow said halves to be joined together in a connecting relationship;

said elongated center portion of said upper half having a curved surface defining a partial ellipse, said curved surface being convex relative to the horizontal plane when viewed from the side, said elongated center portion of said lower half having a lower surface;

said upper half and said lower half being joined at their rounded half end portions through the connecting of said connecting means to form two rounded core ends;

said connecting of said upper and lower halves forming a cavity between said curved surface of said upper elongated portion and said lower surface of said lower elongated portion;

wherein said connecting means comprises an arrangement of at least two studs and two apertures located on said halves so that said studs are located diagonally with respect to each other and said apertures are located diagonally with respect to each other; and a keyway located within said cavity.

17. A compact tape product as defined in claim 16, wherein said lower surface is also curved and defines a partial ellipse so that said lower surface is convex relative to the horizontal plane when said structure is viewed from the side.

18. A compact tape product as defined in claim 16, wherein said keyway is mounted within said cavity via supporting members that are connected to said curved surface of said upper elongated portion and said lower surface.

19. A compact tape product as defined in claim 16, wherein said upper half and said lower half are permanently joined together with a hinge mechanism at one of said rounded half end portions.

* * * * *